US006321933B1

(12) United States Patent
Vandenberg

(10) Patent No.: US 6,321,933 B1
(45) Date of Patent: Nov. 27, 2001

(54) TOY JEWEL TRADER: JANGLE

(76) Inventor: Anthony Peter Vandenberg, 600 Heather La., Charlotte, NC (US) 28209

( * ) Notice: Subject to any disclaimer, the term of this patent is extended or adjusted under 35 U.S.C. 154(b) by 0 days.

(21) Appl. No.: 09/563,438

(22) Filed: May 1, 2000

(51) Int. Cl.[7] ..... A24F 15/04
(52) U.S. Cl. ..... 221/24; 221/185
(58) Field of Search ..... 221/185, 250, 221/24, 155, 92, 123, 131, 265

(56) References Cited

U.S. PATENT DOCUMENTS 4,381,845 * 5/1983 Feis ..... 221/185
5,826,746 * 10/1998 Ash, Jr. ..... 221/185

* cited by examiner

*Primary Examiner*—Kenneth W. Noland

(57) ABSTRACT

A toy jewel trader which can be used easily docked universally to the same type toy jewel trader without the need for male and female models and allow for the fun and accurate trading and display of toy jewels among children. The toy cleanup toy jewel trader compromises: a swivelled clip for quick attachment to belt loops, knapsacks or book-bags; a transparent chambered container for storing and displaying three jewel value types; a dock platform with pegs and holes for aligning and permitting docking of a similar toy jewel trader while simultaneously disengaging transfer piston brakes; a dock platform with mating north and south magnets for attracting a similar toy jewel trader and securing firmly during jewel transfer; spring loaded transfer buttons for the forcible transferring of jewels through cross-cut transfer ports of docked toy jewel traders; piston brakes for preventing accidental jewel ejection and eliminating direct handling of jewels by children.

1 Claim, 9 Drawing Sheets

TOY JEWEL TRADER: JANGLE

BACKGROUND—FIELD OF INVENTION

This invention relates to a toy jewel trading device utilized for the quick, accurate and fun trading of valuable toy jewels for children.

BACKGROUND—DESCRIPTION OF RELATED ART

Children enjoying trading things for favors, toys, and other goods, however there has been no universal docking trader toy that allows them to trade and barter these transactions accurately and in a fun manner. Nothing in the patent search was found in which a toy jewel trading device magnetically docks with a similar toy device to accurately trade different value toy jewels for children trade transactions and prevent accidental ejection of jewels or direct handling of the jewels by children.

OBJECT AND ADVANTAGES

Several objects and advantages of my invention are:

(a) to provide a toy jewel trader that can be easily clipped onto a child's belt loop, book-bag or knapsack;

(b) to provide a toy jewel trader that holds three jewel value types organized into three independent chambers;

(c) to provide a toy jewel trader that can be easily and amusingly docked to another toy jewel trader by magnetic attraction pads and a peg alignment mechanism without the need for male & female model types;

(d) to provide a toy jewel trader that allows children to trade selected jewels accurately, transferring the same value jewel type to the docked toy jewel trader's respective value jewel chamber;

(e) to provide a toy jewel trader that is transparent and allows children to clearly see the accumulated jewels as well as the actual transfer of the jewels from one toy jewel trader to the next;

(f) to provide a toy jewel trader that prevents jewels from being accidently ejected, and allows jewel transfer only when toy jewel traders are docked so that children never handle jewels directly.

Still further objects and advantages will become apparent from a consideration of the ensuing description and drawings.

DRAWING FIGURES

Although the present embodiment of this invention is made from transparent molded thermoplastics, some visible objects behind the target object are not shown for greater figure clarity.

Figure 1:
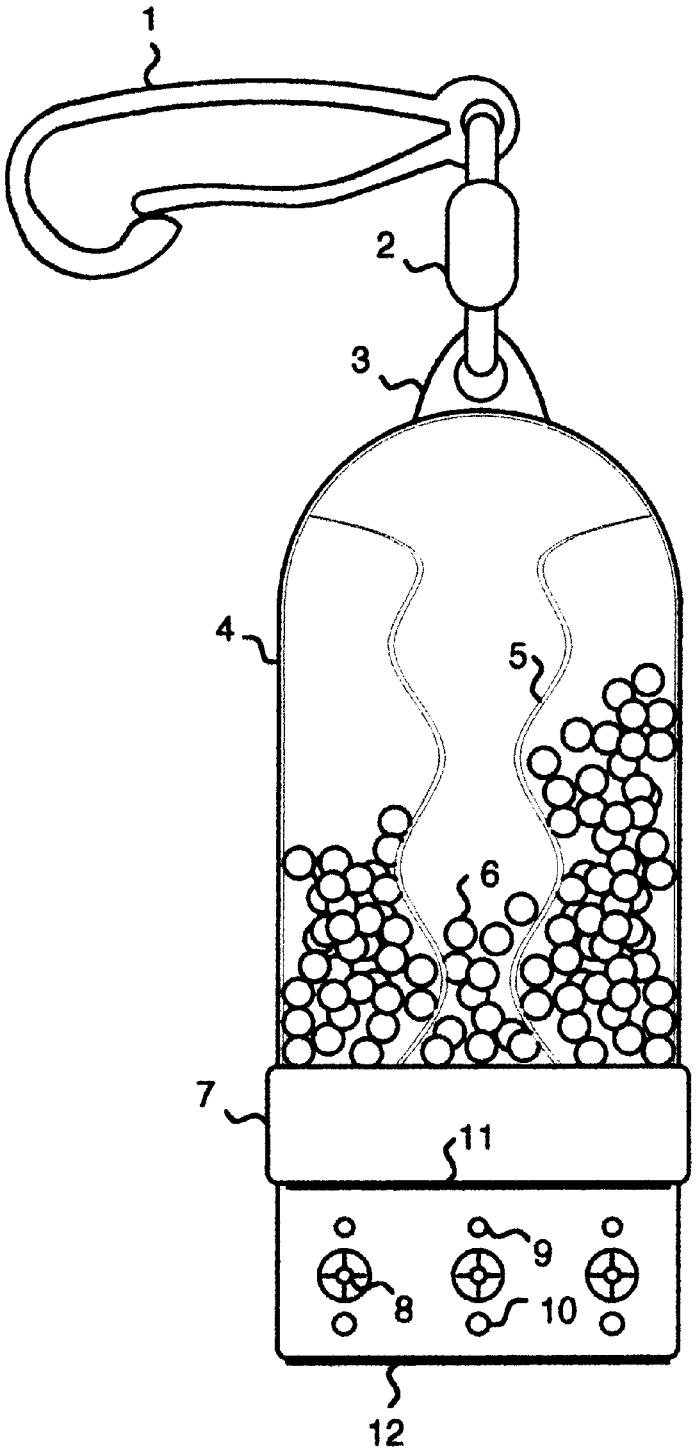

FIG. 1: shows a front view of the toy jewel trader with representative jewels in chambers.

Figure 2:
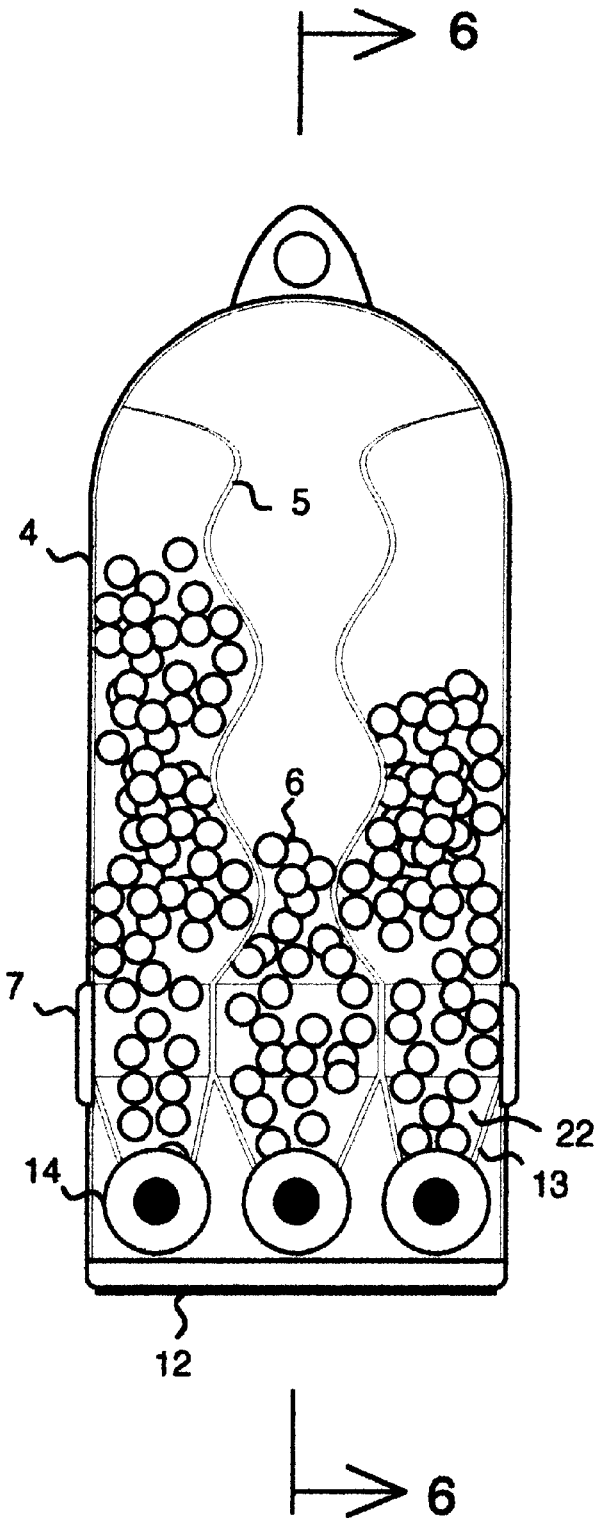

FIG. 2: shows a back view of the toy jewel trader with representative jewels in chambers.

Figure 3:
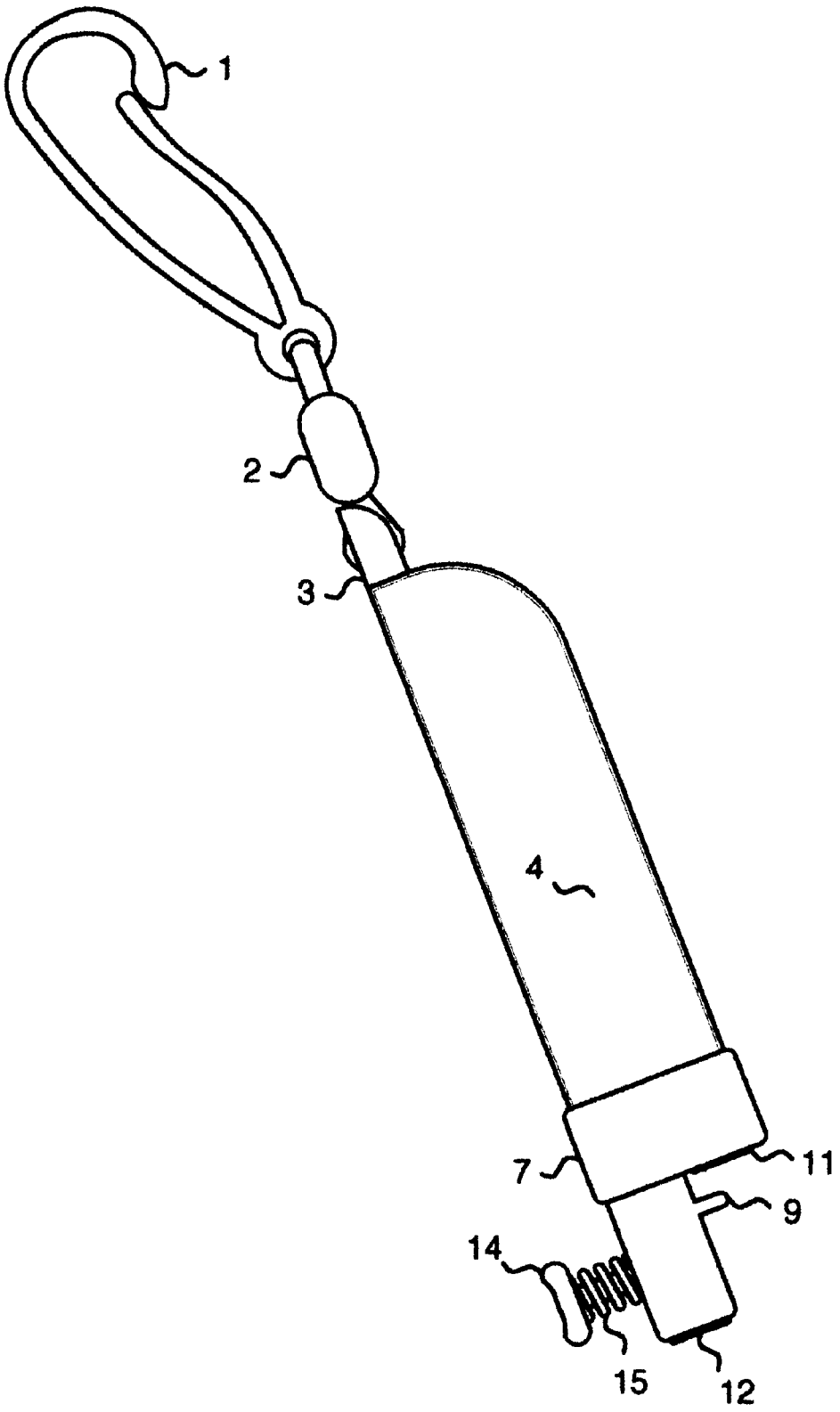

FIG. 3: shows a side view of the toy jewel trader.

Figure 4:
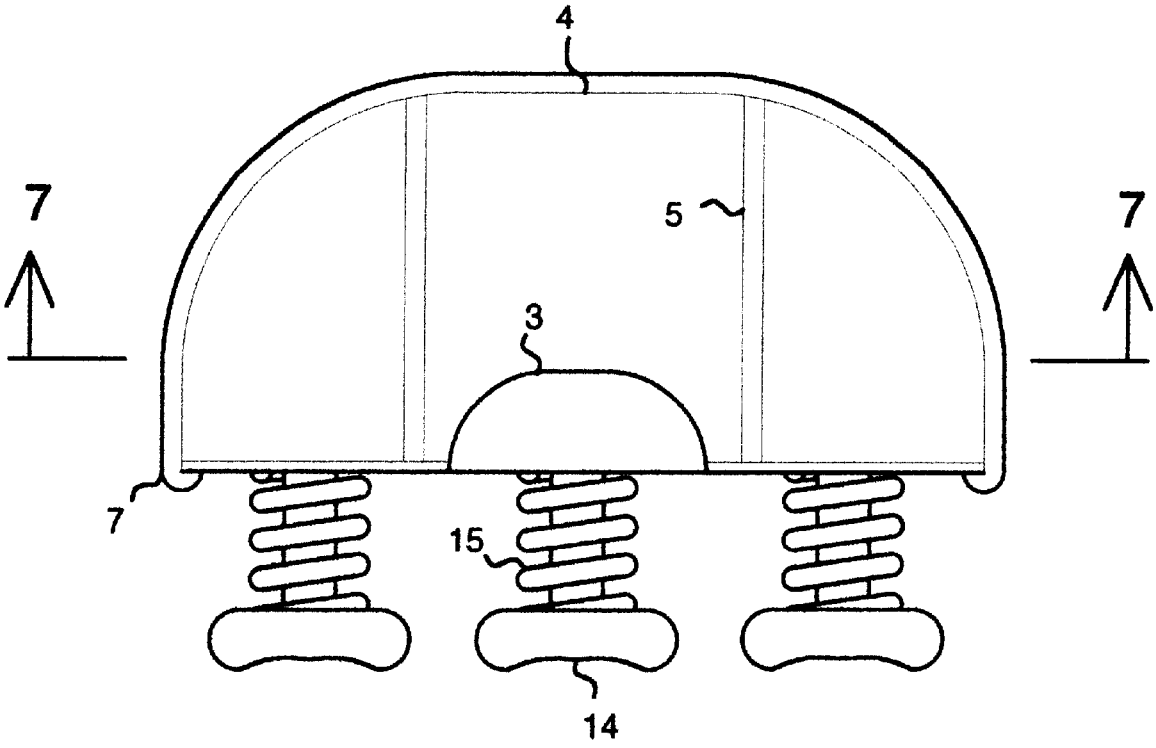

FIG. 4: shows a top view of the toy jewel trader.

Figure 5:
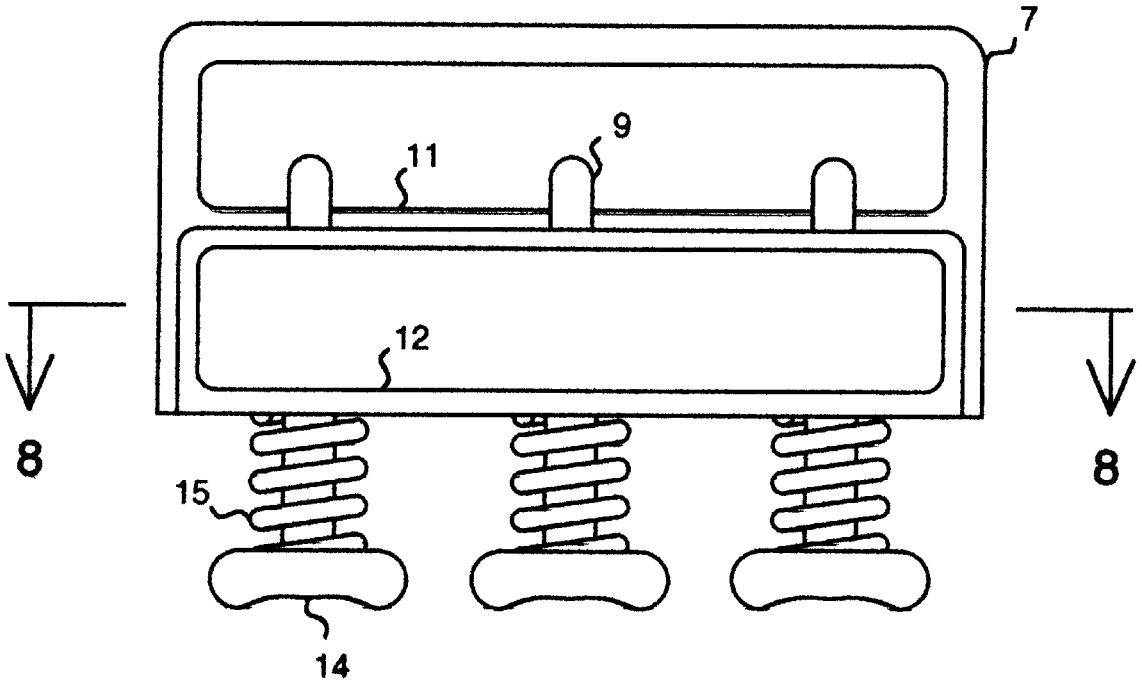

FIG. 5: shows a bottom view of the toy jewel trader.

Figure 6:
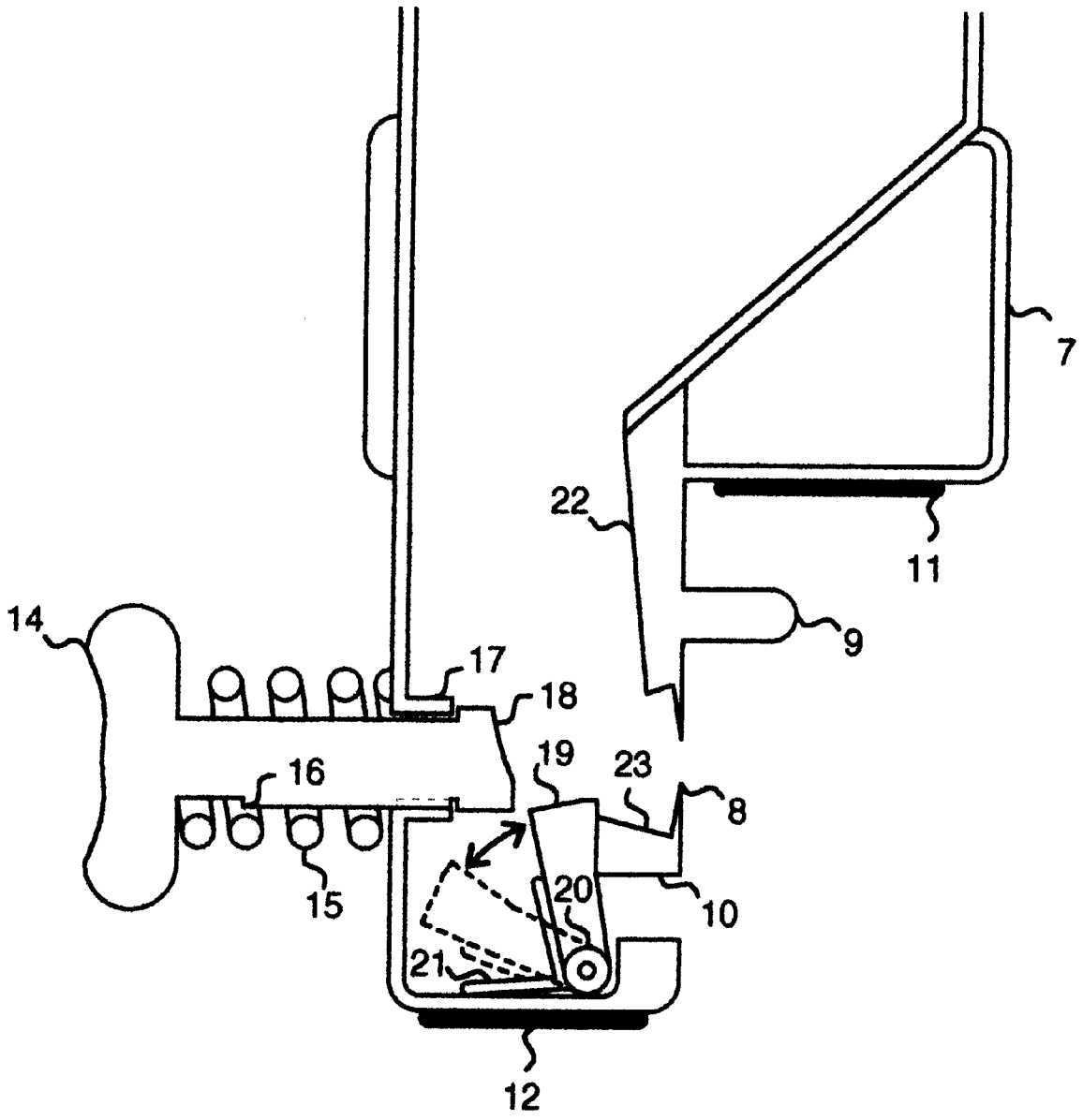

FIG. 6: shows a longitudinal section view through the center of the toy jewel trader and the motion of a flap brake.

Figure 7:
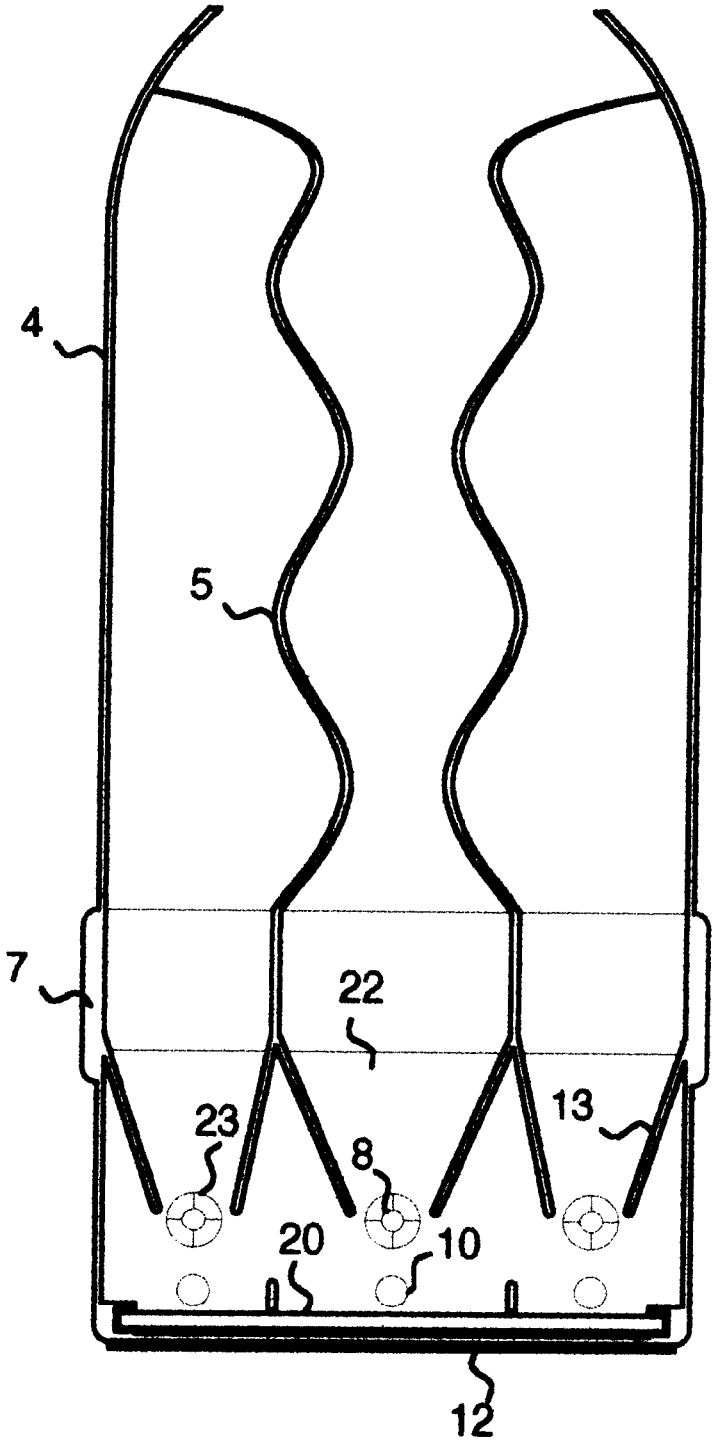

FIG. 7: shows a lateral section view to the front of the toy jewel trader.

Figure 8:
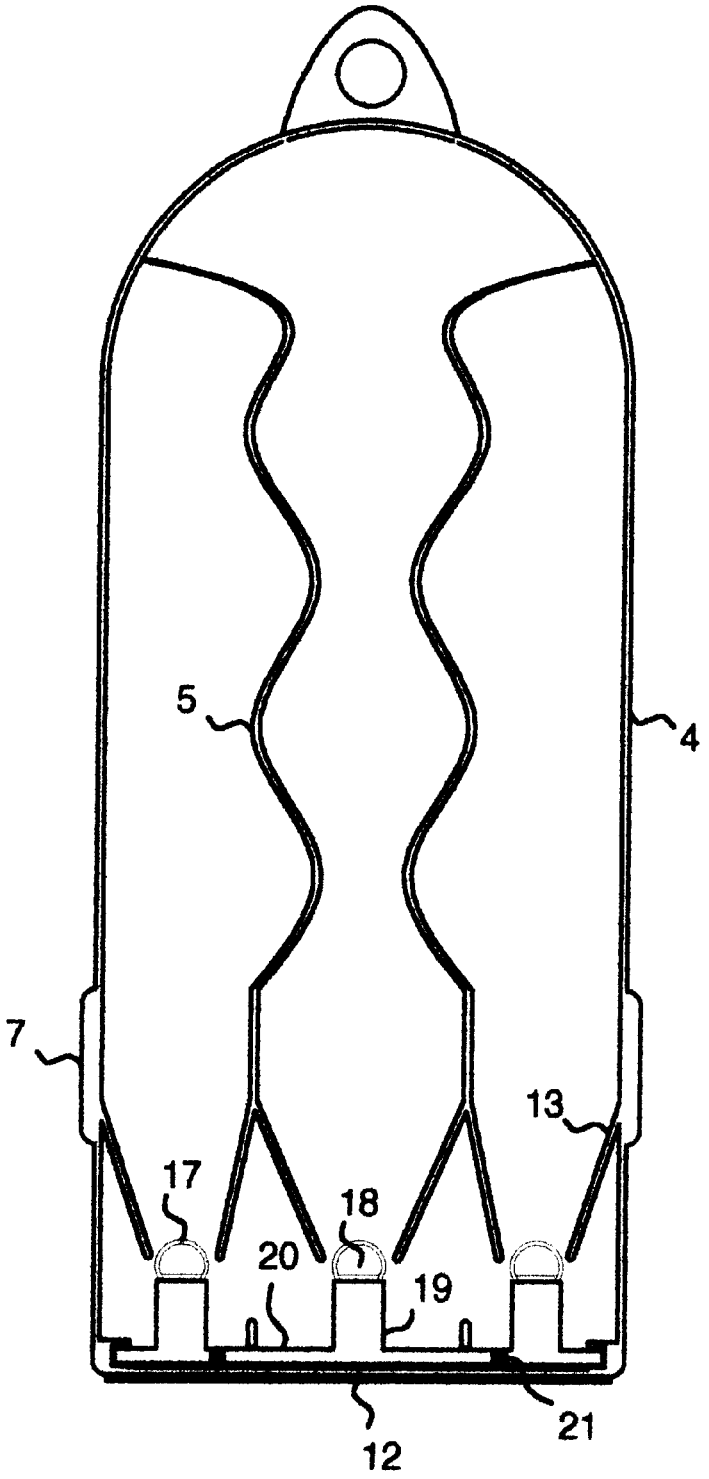

FIG. 8: shows a lateral section view to the back of the toy jewel trader.

Figure 9:
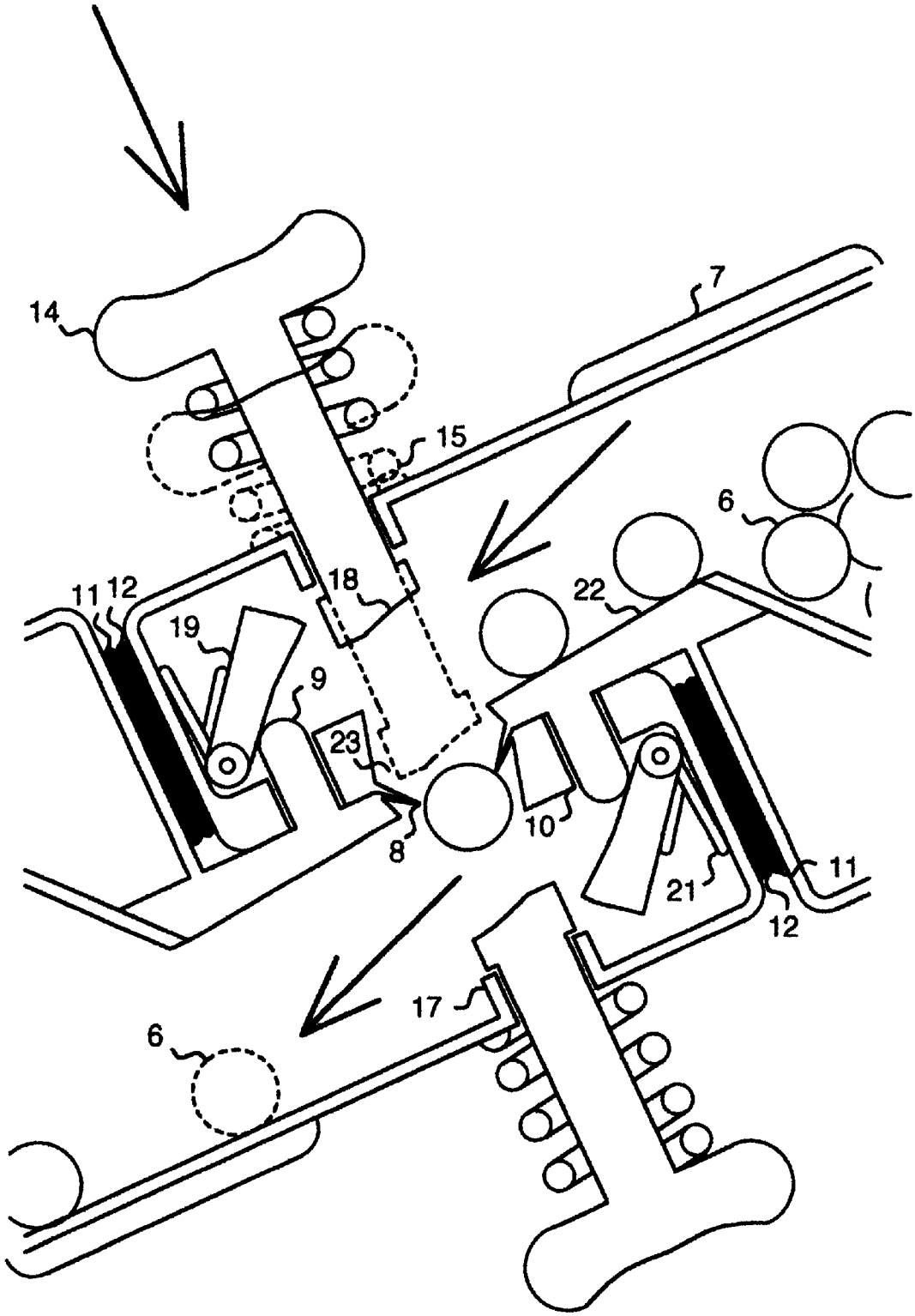

FIG. 9: shows a longitudinal section view through the center of two docked toy jewel traders and the transfer of representative jewels.

| Reference Numerals In Drawings | |
|---|---|
| 1 | Clip |
| 2 | Swivel |
| 3 | Clip Mount |
| 4 | Display Storage Container |
| 5 | Chamber Wall |
| 6 | Representative Jewel |
| 7 | Dock Platform |
| 8 | Transfer Port |
| 9 | Align Peg |
| 10 | Peg Hole |
| 11 | North Magnet Strip |
| 12 | South Magnet Strip |
| 13 | Funnel Chute |
| 14 | Transfer Button |
| 15 | Transfer Return Spring |
| 16 | Button Rod |
| 17 | Rod Sleeve |
| 18 | Piston Head |
| 19 | Brake Shaft |
| 20 | Piston Brake Flaps |
| 21 | Shut Spring |
| 22 | Load Slope |
| 23 | Load Chamber |

SUMMARY

In accordance with the present invention a toy jewel trader which compromises: a swivelled clip for quick attachment to belt loops, knapsacks or book-bags; a transparent chambered container for storing and displaying three jewel value types; a dock platform with pegs and holes for aligning and permitting docking of a similar toy jewel trader while simultaneously disengaging transfer piston brakes; a dock platform with mating north and south magnets for attracting a similar toy jewel trader and securing firmly during jewel transfer; spring loaded transfer buttons for the forcible transferring of jewels through cross-cut transfer ports of docked toy jewel traders; piston brakes for preventing accidental jewel ejection and eliminating direct handling of jewels by children; for the purpose of providing quick, accurate, fun, highly visible and organized trading of three toy jewel value types.

Description—FIGS. 1–9

A typical embodiment of the toy jewel trader of the present invention is illustrated in FIG. 1–9 with typical dimensions of 40 mm width×100 mm length×20 mm height. The present embodiment of this invention is for utilization with three highly reflective jewel ball types: gold, silver, and sapphire. A typical embodiment of the toy jewel trader would be initially equipped with 15 gold jewel balls, 30 silver jewel balls, and 40 sapphire jewel balls. All portions of this invention, except dock platform, transfer buttons, and return springs, are made from clear and colored transparent molded thermoplastics. Other embodiments of this invention may include different dimensional configurations to accommodate additional jewel types or sizes.

The toy jewel trader has a clip 1 connected to a clip mount 3 by a swivel 2. Clip mount 3 is integrally attached to the top of a display storage chamber 4. Display storage chamber 4 is divided into three independent chambers by two curving chamber walls 5. Chamber walls 5 run from the top display storage chamber 4 to the bottom ending in narrow funnel chutes 13. Representative jewels 6 are stored and displayed in display storage chamber 4, FIG. 1 and FIG. 2.

Connected to the base of display storage chamber 4 is a dock platform 7. Dock platform 7 is stepped with three docking surfaces: when viewed from the side, vertical—horizontal—vertical. Spaced exactly in the center of the first vertical docking surface is a thin north magnet strip 11. Spaced exactly in the center of the second vertical docking surface is a thin south magnet strip 12, FIG. 3 and FIG. 5. On the inner corner of the exterior horizontal surface of dock platform 7 are three equally spaced align pegs 9. On the outer end of the horizontal surface of dock platform 7 are three equally spaced peg holes 10 that open into the interior of dock platform 7. Centered between align pegs 9 and peg holes 10 are three cross cut transfer ports 8. Transfer ports 8 hole diameters are smaller than the diameter of jewels 6, but have tapering lips at hole circumference and cross cuts longer than the diameter of jewels 6 to allow for forced passage of jewels 6 and prevent jewel 6 from freely falling out of toy jewel trader, FIG. 1, FIG. 3, and FIG. 6. Two toy jewel traders are docked by inverting and rotating one jewel trader so that its dock platform 7 is mated onto dock platform 7 of the other toy jewel trader aligning respective transfer ports 8. Toy jewel traders are attracted together and secured firmly in mated position by north magnet strips 11 and south magnet strip 12, FIG. 9.

Protruding out of the bottom back face of display storage container 4 and at the apex of funnel chutes 13 are three push transfer buttons 14 colored in corresponding colors to the respective jewel of that chamber. Between the transfer buttons 14 and the outer wall of display storage container 4 are transfer return springs 15 that return transfer buttons 14 to original positions after being depressed. Connected integrally to transfer buttons 14 are button rods 16 that slide within rod sleeves 17 located on the interior bottom back face of display storage container 4. On the bottom quadrant of button rods 16 are knobs that fit within corresponding recesses in rod sleeves 17 to prevent rotation of transfer buttons 14, FIG. 4, FIG. 5, and FIG. 6. Integrally connected to the ends of button rods 16 are piston heads 18. The bottom ¼ portion of piston heads 18 have a flat surface with the remaining surface concave with the same radius as jewels 6. The centers of piston heads 18 are centered directly below the centers of transfer ports 8, FIG. 6.

Immediately below the interior wall of the horizontal docking face and behind peg holes 10 running the width of dock platform 7. is a brake shaft 19 set through slots to allow for free rotation. Integrally attached to brake shaft 19 are three piston brake flaps 20 aligned center with piston heads 18. Wrapped around brake shaft 19 are two shuts springs 21 with spring ends pushing against the under-surface of the outer two brake flaps 20 and the interior wall of the second vertical docking face of dock platform 7, FIG. 6, FIG. 7 and FIG. 8.

Immediately below transfer ports 10 are three load chambers 23. Leading from the front surface of the display storage container 4 and between the funnel chutes 13 are three load slopes 22. When the top jewel trader is inverted atop the bottom jewel trader during docking, jewels 6 in the top jewel trader individually gravity feed down load slopes 22 into load chambers 23, FIG. 9. When not docked, brake flaps 19 are held securely against the interior wall of the horizontal docking face of dock platform 7 covering peg holes 10 and blocking transfer movement of piston heads 18 into load chambers 23 preventing accidental jewel ejection, FIG. 6 and FIG. 9. When two toy jewel traders are docked, align pegs 9 enter respective peg holes 10 striking and rotating back brake flaps 20 allowing piston heads 18 clearance to enter load chambers 23 and transfer selected jewels 6 through transfer ports 8 when transfer button 14 of the top toy jewel trader is completely depressed.

Operation—FIGS. 1–9

Toy jewel traders come initially equipped with 15 gold jewel balls, 30 silver jewel balls, and 40 sapphire jewel balls each jewel type stored separately in display storage container 4 in predetermined order. Children prominently carry the toy traders attached to their knapsack or book-bag by clip 1 so that their jewel wealth can be displayed clearly and attractively for other potential traders to notice, FIG. 1 and FIG. 2.

Children barter and negotiate the value type and number of jewels 6 for a trade. Once a decision has been made, the buying child rotates and inverts his toy jewel trader atop the seller's by mating align pegs 9 into peg holes 10 of the seller's toy jewel trader dock platform 7 and allowing opposite north magnet strip 11 and south magnet strip 12 to pull the two toy jewel traders firmly together. During the docking process the align pegs 9 disengage the piston brake flaps 20 and permit free movement of piston heads 18. The docked toy jewel traders are held by the buyer at angle as required by the volume of jewel contents in a particular chamber to load jewels 6 onto load slope 22 and into load chamber 23. The buyer can confirm loaded load chamber 23 through the transparent underside of display storage container 4. Because the top toy jewel trader is inverted and rotated respective to the bottom toy jewel trader during docking, corresponding transfer ports 8 are aligned and there is no mixing of different value jewel types between the docked toy jewel traders.

The buyer depresses the corresponding transfer button 14 which pushes piston head 18 to forcibly push loaded jewel 6 through the buyer's and seller's transfer ports 8 and into the seller's toy jewel trader. The transferred jewel 6 rolls downward into the seller's tilted top of display storage container 4. If the seller is to return change jewels, the docked toy jewel traders are simply inverted without un-docking and the seller depresses transfer buttons 14 as required to transfer the correct change. Toy jewel traders are un-docked by simply pulling apart. Once un-docked, piston brake flaps 20 are returned to locked positions blocking movement of piston head 18 into load chamber 23, preventing both the accidental ejection of jewels 6 and the direct handling of jewels 6 by children.

Summary, Ramifications, and Scope

Accordingly, the reader will see that my invention will be fun and accurate for facilitating children trade transactions. Furthermore, my invention has the additional advantages in that:

(a) it provide children a fun and attractive method for making trades and displaying and carrying their accumulated jewel wealth.

(b) it provides guardians and parents a safe way to allow children to play trading games.

(c) it allow children to experience first hand cause-effect relationships particularly in terms of negotiating, effort and reward through the trading process.

Although the description above contains many specificities, these should not be construed as limiting the scope of the invention but as merely providing illustrations of some of the presently preferred embodiments of this invention. For example the toy jewel trader could:

(a) have components with different shapes, levels of transparency, or portions colored or translucent;

(b) have a different dimension configurations to accommodate larger or more jewel types;

(c) uses different representative articles other than gold, silver and sapphire such as representative balls of popular cartoon characters;

(d) have graduations on the display storage container so that children could estimate the total jewel contents without counting individually.

Thus the scope for the invention should be determined by the appended claims and their legal equivalents, rather than by the examples given.

I claim:

1. A toy jewel trader for use in conducting children's trade transactions, compromising:

(a) a swiveled clip for attachment to person or bag, (b) a clear display storage with multiple chambers for storing and prominently displaying toy jewels, (c) a universal peg and hole magnetic dock platform for the mate docking of two toy jewel traders firmly and in exact position to transfer respective jewels to respective chambers between two toy jewel traders, (d) spring loaded transfer buttons and piston heads and cross cut transfer ports for forcibly transferring jewels between docked toy jewel traders, (e) spring loaded flap brakes and cross cut transfer ports for preventing accidental ejection of jewels and direct handling of jewels by children, whereby said toy jewel trader will allow children to accurately and amusingly conduct trade transactions and display accumulated wealth, and whereby said toy jewel trader will provides guardians and parents a safe way to allow children to play trading games, and whereby said toy jewel trader will allow children to experience first hand cause-effect relationships in terms of negotiating, effort and reward through the trading process.

* * * * *